US010994893B2

(12) United States Patent
Oltman et al.

(10) Patent No.: US 10,994,893 B2
(45) Date of Patent: May 4, 2021

(54) LIQUID STORAGE TANK

(71) Applicant: Snyder Industries, Inc., Lincoln, NE (US)

(72) Inventors: Darrell A. Oltman, Lincoln, NE (US); Herbert H. Spann, Lincoln, NE (US); Colin James Suiter, Downers Grove, IL (US)

(73) Assignee: Snyder Industries, LLC, Lincoln, NE (US)

( * ) Notice: Subject to any disclaimer, the term of this patent is extended or adjusted under 35 U.S.C. 154(b) by 335 days.

(21) Appl. No.: 15/810,444

(22) Filed: Nov. 13, 2017

(65) Prior Publication Data

US 2019/0144165 A1 May 16, 2019

(51) Int. Cl.

| | |
|---|---|
| ***B65D 25/24*** | (2006.01) |
| ***B65D 25/22*** | (2006.01) |
| ***B65D 39/08*** | (2006.01) |
| ***B65D 1/20*** | (2006.01) |
| ***B65D 1/12*** | (2006.01) |

(52) U.S. Cl.

CPC ..... *B65D 25/24* (2013.01); *B65D 1/12* (2013.01); *B65D 1/20* (2013.01); *B65D 25/22* (2013.01); *B65D 39/082* (2013.01); *B65D 39/084* (2013.01); *B65D 39/088* (2013.01)

(58) Field of Classification Search

CPC ..... B65D 25/24; B65D 39/082; B65D 25/22; B65D 39/088; B65D 39/084; B65D 1/20; B65D 1/12; B65D 7/045; B65D 11/06; B65D 21/022; B67B 7/16

USPC ..... 220/601, 724, 320, 4.12; 137/382, 588; 81/3.08, 3.55; 206/592

See application file for complete search history.

(56) References Cited

U.S. PATENT DOCUMENTS

| | | | | |
|---|---|---|---|---|
| 2,481,015 | A * | 9/1949 | Ingersoll | B65D 7/045 220/634 |
| 4,925,049 | A * | 5/1990 | Przytulla | B65D 1/16 220/675 |
| 5,881,898 | A * | 3/1999 | Irwin | B65D 1/16 220/319 |
| 10,189,695 | B2 * | 1/2019 | Brinkworth | B67D 1/1477 |
| 2006/0138151 | A1 * | 6/2006 | Schutz | B65D 1/20 220/601 |
| 2016/0264389 | A1 * | 9/2016 | Guterman | B67B 7/16 |

(Continued)

OTHER PUBLICATIONS https://www.fleetmanconsulting.com/forklift-fork-selection-chart, Fleetman Consulting, 2020, title date 2020.*

(Continued)

*Primary Examiner* — Anthony D Stashick
*Assistant Examiner* — James M Van Buskirk
(74) *Attorney, Agent, or Firm* — Hovey Williams LLP

(57) ABSTRACT

A liquid storage tank broadly comprising a drum, a bottom chime, and a top chime. The bottom chime and top chime each include drum engaging geometry for positively connecting the chimes to the drum and retaining the chimes on the drum when the drum is holding liquid and subjected to lifting forces. The top chime also includes forklift openings and alignment and anti-rotation geometry configured to prevent the top chime from rotating relative to the drum when the drum is lifted via a forklift fork extending through the forklift openings so that the forklift fork does not damage a top wall or bung openings of the drum.

18 Claims, 8 Drawing Sheets

(56) References Cited

U.S. PATENT DOCUMENTS

| | | | | |
|---|---|---|---|---|
| 2018/0222657 | A1* | 8/2018 | Rundin | B65D 11/06 |
| 2019/0112106 | A1* | 4/2019 | Malin | B65D 1/42 |

OTHER PUBLICATIONS https://www.fleetmanconsulting.com—article published by Modern materials handling Dec. 2016, title date Jan. 3, 2017 to show priority.*

* cited by examiner

LIQUID STORAGE TANK

BACKGROUND

Liquid storage tanks are often used for storing, transporting, and dispensing chemicals, petroleum products, and other liquids. Modern liquid storage tanks are typically formed of molded plastic due to low manufacturing costs and the inert quality of plastics. Most plastic liquid storage tanks include a drum for holding the liquids and top and bottom chimes for protecting the top and bottom walls of the drum and for elevating the drum for easy stacking. However, the chimes can accidentally shift or be uncoupled from the drum especially when the tank is being lifted, handled, or stacked. This may result in injuries, damage to the drum's bung openings, and/or expensive, messy, and hazardous liquid spills. Moreover, the top chimes, which often have handles or channels for accommodating forklift tines, are often not aligned on the drums properly, which can cause damage to the drums' bung openings when the drums are lifted. Some chimes include alignment features, but they often do not retain the chimes in alignment with the drum when the tank is being lifted, handled, or stacked.

SUMMARY

Embodiments of the invention solve the above-mentioned problems and provide a distinct advance in liquid storage tanks. More particularly, the invention provides a liquid storage tank with chimes that are more securely attached to their drum and that can be safely lifted, handled, and stacked from above via a forklift.

An embodiment of the liquid storage tank broadly comprises a drum, a bottom chime, and a top chime. The drum includes a substantially vertically extending sidewall, a top wall, and a bottom wall cooperatively forming a hollow interior chamber. The sidewall is cylindrical and includes opposing top and bottom annular edges.

The top wall includes an outer edge, a set of bung rims, a drainage channel, security seal bosses, and an annular groove and female recess, the purpose of which will be described below. The outer edge connects the top wall to the top annular edge of the sidewall.

The bung rims extend upwardly from the top wall so as to form a set of bung openings. The bung openings may have a "straight-straight" configuration or a "straight-angled" configuration such that one of the bung openings is slightly angled from vertical. The bung rims may include helical threads or other interlocking geometry for securing bung caps (described below) in the bung openings. The bung rims are spaced from each other and offset from the center of the top wall and may be positioned along the horizontal centerline of the top wall.

The bung caps form a watertight seal when inserted into the bung openings and may include security seal bosses and helical threads or other interlocking geometry for engaging the bung rims. The bung caps may have one of a number of topside geometries such as helical threads for connecting a hose, pipe, spigot, or other conduit to the drum.

The drainage channel allows water to drain off the top wall when the top chime is connected to the drum and is positioned near the outer edge of the top wall. The drainage channel may be a downward-sloping recess, notch, groove, or similar depression.

The bottom wall includes an outer edge, sump geometry, and an annular groove, the purpose of which will be described below. The outer edge connects the bottom wall to the bottom annular edge of the sidewall. The sump geometry is a bowl or funnel-shaped region for drawing liquids from the bottom of the interior chamber.

The bottom chime elevates the drum above a ground surface and includes a substantially vertically extending sidewall, stacking geometry, and an annular lip (the purpose of which will be described below). The sidewall supports the weight of liquids stored in the interior chamber of the drum and includes opposing inner and outer faces. The inner and/or outer faces may include ribs or other reinforcement geometry for increasing strength and preventing the bottom chime from bowing and warping. The stacking geometry is configured to engage stacking geometry of a top chime of another tank so that the tanks can be stacked in a vertical column. The stacking geometry may be a groove, channel, lip, flange, tab, guide, or any combination thereof.

The top chime protects the top wall of the drum and includes a substantially vertically extending sidewall, stacking geometry, forklift openings, and an annular lip and male lug protrusion (the purpose of which will be described below). The sidewall supports the weight of liquids stored in the interior chamber of the drum when the tank is lifted via a forklift and includes opposing inner and outer faces. The inner and/or outer faces may include ribs or other reinforcement geometry for increasing strength and preventing the top chime from bowing and warping. The stacking geometry is configured to engage stacking geometry of a bottom chime of another tank so that the tanks can be stacked in a vertical column. The stacking geometry may be a groove, channel, lip, flange, tab, guide, or any combination thereof. The forklift openings extend through the sidewall of the top chime for receiving a forklift fork therethrough. The forklift openings bisect the top chime so that the forklift fork lifts the tank directly over its center of gravity.

The annular groove of the bottom wall of the drum and the annular lip of the bottom chime cooperatively form bottom engaging geometry for positively retaining the bottom chime on the drum. The bottom engaging geometry has at least 2.5 square inches of positive engagement area for ensuring that the bottom chime is retained on the drum during handling. It will be understood that other engaging geometries such as channels, flanges, and tabs may be used.

The annular groove of the top wall of the drum and the annular lip of the top chime cooperatively form top engaging geometry for positively retaining the top chime on the drum. The top engaging geometry has at least 2.5 square inches of positive engagement area for ensuring that the top chime is retained on the drum when the drum is lifted with liquid in the interior chamber. It will be understood that other engaging geometries such as channels, flanges, and tabs may be used.

The female recess of the top wall of the drum and the male lug protrusion of the top chime cooperatively form top chime alignment and anti-rotation geometry for securing the top chime on the drum in a lifting orientation. Importantly, the male lug protrusion and/or an engagement area of the top chime alignment and anti-rotation geometry is at least 0.5 inches long, has a thickness to width ratio of at least 0.5, and has a cross sectional area of at least 0.75 square inches. This ensures that the top chime alignment and anti-rotation geometry is strong enough to withstand rotational forces imparted on the top chime when the tank is lifted or handled. It will be understood that other alignment geometries such as notches, grooves, tabs, and flanges may be used.

In use, the bottom chime is installed on the drum such that the bottom engaging geometry is securely interlocked together. Similarly, the top chime is installed on the drum such that the top engaging geometry is securely interlocked together. The top chime is also positioned such that the top chime alignment and anti-rotation geometry orients and retains the forklift openings such that a forklift fork extending through the forklift openings passes between the bung openings without obscuring the bung openings and without damaging the bung rims or the top wall of the drum near the bung openings.

The above-described liquid storage tank provides several advantages. For example, the alignment and anti-rotation geometry orient and retain the forklift openings such that a forklift fork extending through the forklift openings passes between the bung openings without obscuring the bung openings and without damaging the bung rims or the top wall of the drum near the bung openings. The alignment and anti-rotation geometry is strong enough to prevent rotation of the top chime relative to the drum even when subjected to twisting forces associated with lifting the tank. The bottom engagement geometry and top engagement geometry are strong enough to retain the chimes on the drum when the liquid storage tank is lifted with liquid in the interior chamber. The drainage channel allows for water to drain off the top wall of the drum without needing to tip the tank or removing the top chime from the drum.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
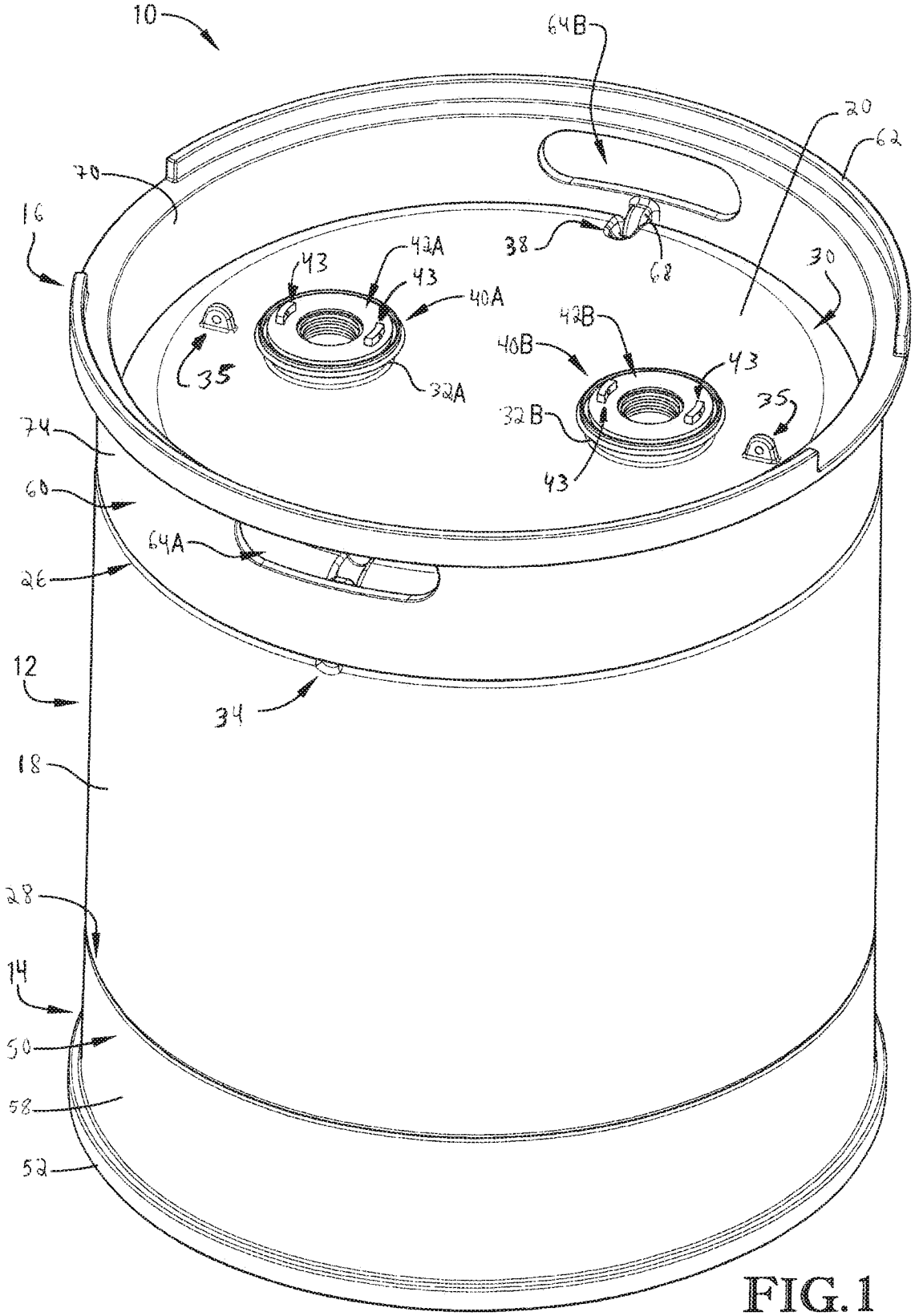
FIG. 1 is a perspective view of a liquid storage tank constructed in accordance with an embodiment of the invention.
Figure 2:
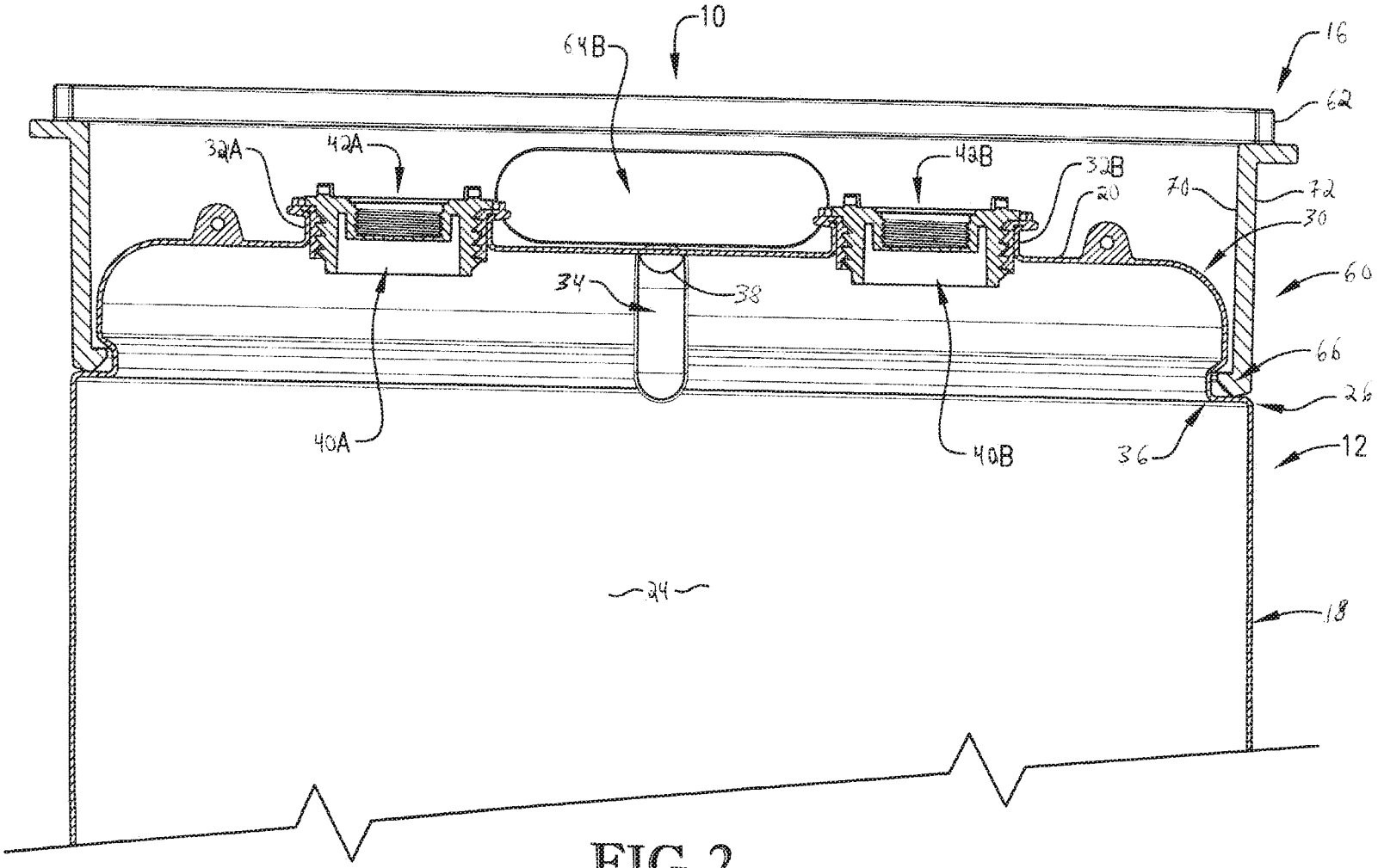
FIG. 2 is an enlarged partial cutaway view of a top portion of the liquid storage tank of FIG. 1.
Figure 3:
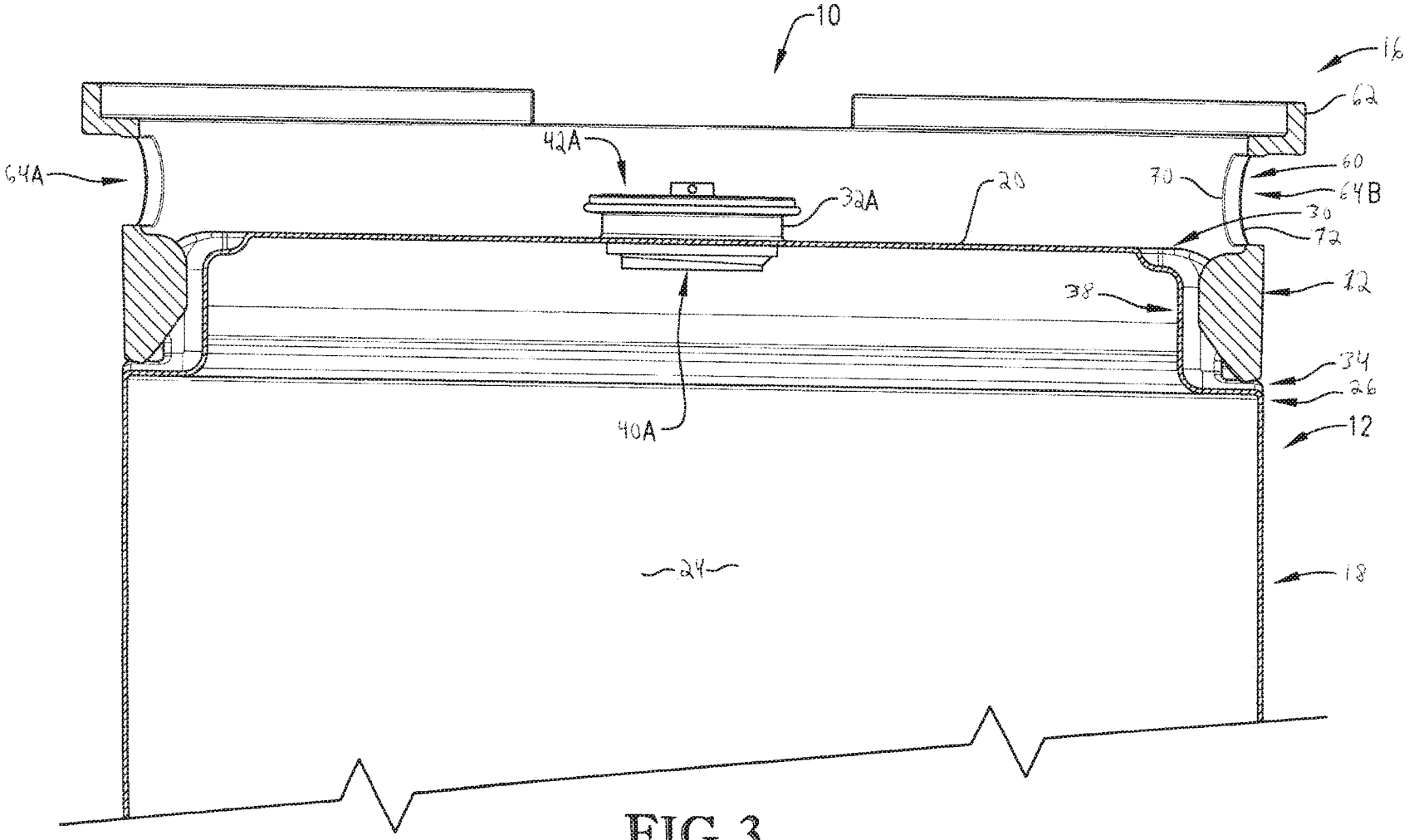
FIG. 3 is an enlarged partial cutaway view of a top portion of the liquid storage tank of FIG. 1.
Figure 4:
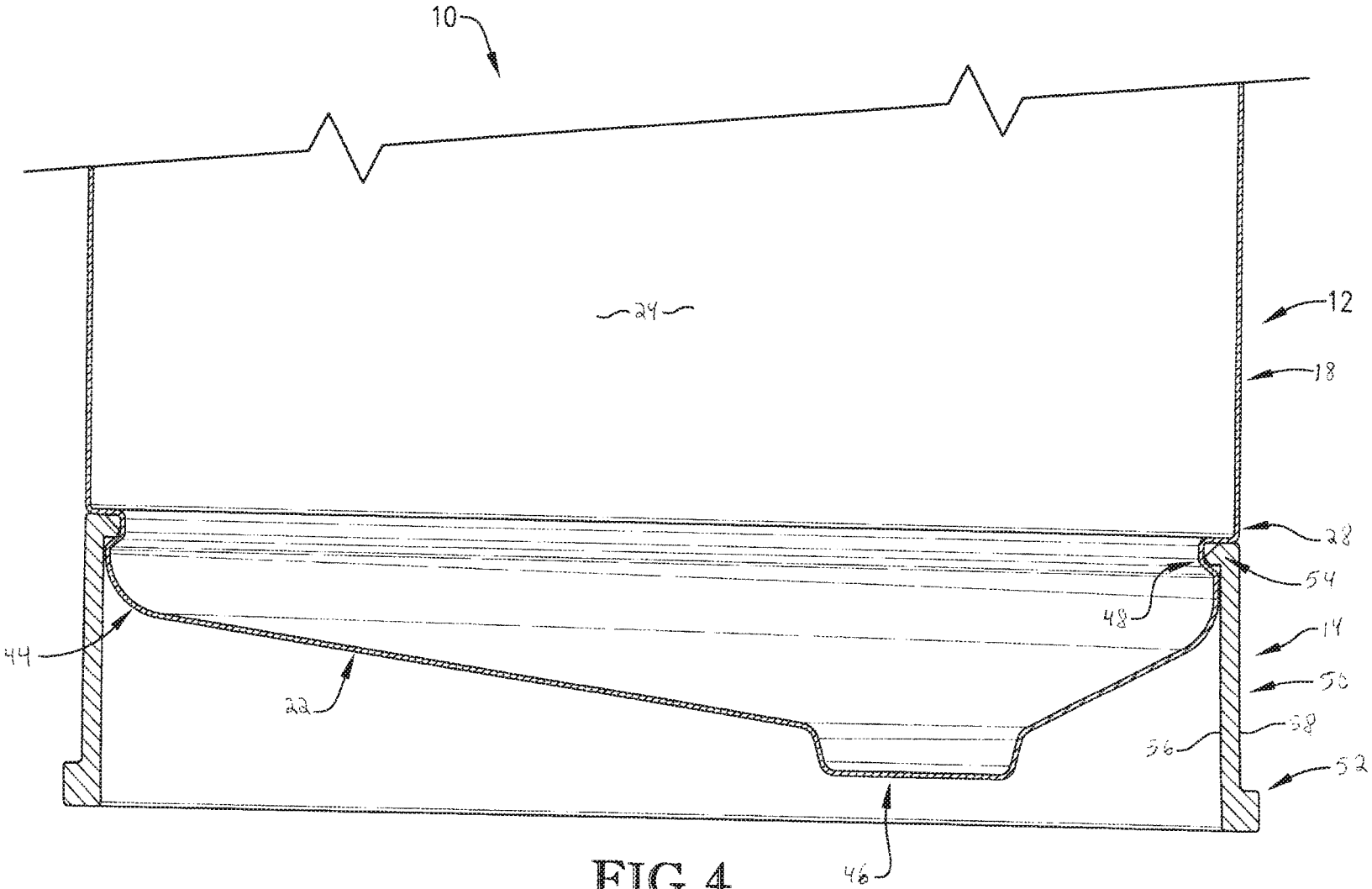
FIG. 4 is an enlarged partial cutaway view of a bottom portion of the liquid storage tank of FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, and initially FIGS. 1-4, a liquid storage tank 10 constructed in accordance with an embodiment of the invention is illustrated. The liquid storage tank 10 broadly comprises a drum 12, a bottom chime 14, and a top chime 16.

The drum 12 stores liquids and includes a substantially vertically extending sidewall 18, a top wall 20, and a bottom wall 22 cooperatively forming an interior chamber 24 configured to hold up to 15 U.S. gallons. However, any suitable drum size, such as 5 U.S. gallons and 30 U.S. gallons, may be used (see tank 100 of FIG. 5, tank 200 of FIG. 6, and tank 300 of FIG. 7 described below).

The sidewall 18 includes opposing top and bottom annular edges 26, 28 and may be cylindrical or rectangular with filleted corners, or any other suitable shape. The sidewall 18 may also include reinforcement ribs or other strengthening geometry such as ridges and folds.

The top wall 20 includes an outer edge 30, a set of bung rims 32A,B, a drainage channel 34, security seal bosses 35, and an annular groove 36 and female recess 38, the purpose of which will be described below. The security seal bosses 35 allow security seal wires to be connected between bung caps 42A,B (described below) and the top wall 20. The outer edge 30 connects the top wall 20 to the top annular edge 26 of the sidewall 18.

The bung rims 32A,B extend upwardly from the top wall 20 so as to form bung openings 40A,B and may include helical threads or other interlocking geometry for securing the bung caps 42A,B in the bung openings 40A,B. The bung openings 40A,B have a "straight-straight" configuration in which both bung openings 40A,B are vertically oriented. However, other configurations such as a "straight-angled" configuration may be used (see tank 100 of FIG. 5 and tank 200 of FIG. 6 described below). The bung rims 32A,B are spaced from each other and offset from the center of the top wall 20 and may be positioned along the horizontal centerline of the top wall 20.

The bung caps 42A,B form a watertight seal when inserted into the bung openings 40A,B and may include security seal bosses 43 for connecting security seal wires between the bung caps 42A,B and the top wall 20 and helical threads or other interlocking geometry configured to engage the bung rims 32A,B. The bung caps 42A,B may have one of a number of topside geometries including helical geometry for connecting a hose, pipe, spigot, or other conduit to the drum 12 (see bung cap 400 of FIG. 8 as described below), radial or star patterns (see bung cap 500 of FIG. 9 and bung cap 600 of FIG. 10 described below), and annular gripping geometry (see bung cap 600 of FIG. 10 described below). The bung caps 42A,B may be disposable and used primarily for transport to a customer at which point one or both of the bung caps 42A,B may be removed, with accessories and/or equipment being connected to the drum 12 via the bung openings 40A,B. The accessories and equipment may include microvalves, dip tubes, mixers, and other components.

The drainage channel 34 allows water to drain off the top wall 20 of the drum 12 when the top chime 16 is connected to the drum 12 and is positioned near the outer edge 30 of the top wall 20. The drainage channel 34 may allow for a flow rate of between approximately 0.1 U.S. gallons per minute and approximately 1 U.S. gallon per minute. In one embodiment, the drainage channel 34 may allow for a flow rate of 0.5 gallons per minute. It will be understood that the drainage channel 34 may be partially or completely formed in the top chime 16 instead of the top wall 20 of the drum 12.

The bottom wall 22 includes an outer edge 44, sump geometry 46, and an annular groove 48, the purpose of which will be described below. The outer edge 44 connects the bottom wall 22 to the bottom annular edge 28 of the sidewall 18 and may have a convex bowl shape or may be substantially flat. The sump geometry 46 is a bowl or funnel-shaped region for drawing liquids from the bottom of the interior chamber 24.

The bottom chime 14 elevates the drum 12 above a ground surface and includes a substantially vertically extending sidewall 50, stacking geometry 52, and an annular lip 54, the purpose of which will be described below. The sidewall 50 supports the weight of liquids stored in the interior chamber 24 of the drum 12 and includes opposing inner and outer faces 56, 58. The inner and/or outer faces 56, 58 may include ribs or other reinforcement geometry for increasing strength and preventing the bottom chime 14 from bowing and warping. The sidewall 50 may have an outer diameter substantially equal to an outer diameter of the sidewall 18 of the drum 12.

The stacking geometry 52 is configured to engage stacking geometry of a top chime of another tank so that the tanks can be stacked in a vertical column. The stacking geometry 52 may be a groove, channel, lip, flange, tab, guide, or any combination thereof.

The top chime 16 protects the top wall 20 of the drum 12 and includes a substantially vertically extending sidewall 60, stacking geometry 62, forklift openings 64A,B and an annular lip 66 and male lug protrusion 68, the purpose of which will be described below. The sidewall 60 supports the weight of liquids stored in the interior chamber 24 of the drum 12 when the tank 10 is lifted via a forklift and includes opposing inner and outer faces 70, 72. The inner and/or outer faces 70, 72 may include ribs or other reinforcement geometry for increasing strength and preventing the top chime 16 from bowing and warping. The sidewall 60 may have an outer diameter substantially equal to an outer diameter of the sidewall 18 of the drum 12.

The stacking geometry 62 is configured to engage stacking geometry of a bottom chime of another tank so that the tanks can be stacked in a vertical column. The stacking geometry 62 may be a groove, channel, lip, flange, tab, guide, or any combination thereof.

The forklift openings 64A,B extend through the sidewall 60 of the top chime 16 for receiving a forklift fork therethrough. The forklift openings 64A,B bisect the top chime 16 so that the forklift fork lifts the tank 10 directly over its center of gravity. The forklift openings 64A,B have a width of at least 4 inches or any other suitable width.

The annular lip 54 of the bottom chime 14 and the annular groove 48 of the bottom wall 22 of the drum 12 cooperatively form bottom engaging geometry for positively retaining the bottom chime 14 on the drum 12. The bottom engaging geometry has at least 2.5 square inches of positive engagement area for ensuring that the bottom chime 14 is retained on the drum 12 during handling. It will be understood that other engaging geometries such as channels, flanges, and tabs may be used.

The annular lip 66 of the top chime 16 and the annular groove 36 of the top wall 20 of the drum 12 cooperatively form top engaging geometry for positively retaining the top chime 16 on the drum 12. The top engaging geometry has at least 2.5 square inches of positive engagement area for ensuring that the top chime 16 is retained on the drum 12 when the drum 12 is lifted with liquid in the interior chamber 24. It will be understood that other engaging geometries such as channels, flanges, and tabs may be used.

The male lug protrusion 68 and the female recess 38 of the top wall 20 of the drum 12 cooperatively form top chime alignment and anti-rotation geometry for securing the top chime 16 on the drum 12 in a lifting orientation. Importantly, the male lug protrusion and/or an engagement area of the top chime alignment and anti-rotation geometry is at least 0.5 inches long, has a thickness to width ratio of at least 0.5, and has a cross sectional area of at least 0.75 square inches. This ensures that the top chime alignment and anti-rotation geometry is strong enough to withstand rotational forces imparted on the top chime 16 when the tank 10 is lifted or handled. It will be understood that other alignment and anti-rotation geometries such as notches, grooves, tabs, and flanges may be used.

Use of the liquid storage tank 10 will now be described in more detail. The bottom chime 14 is installed on the bottom wall 22 of the drum 12 such that the bottom engaging geometry is interlocked together. The top chime 16 is installed on the top wall 20 of the drum 12 such that the top engaging geometry is interlocked together. The top chime 16 is also positioned so that the alignment and anti-rotation geometry orients and retains the forklift openings 64A,B such that a forklift fork extending through the forklift openings 64A,B passes between the bung openings 40A,B without obscuring the bung openings 40A,B and without damaging the bung rims 32A,B or the top wall 20 of the drum 12 near the bung openings 40A,B.

The bottom chime 14 and top chime 16 may be installed on and removed from the drum 12 via a single-purpose remove-and-replace tool. In other embodiments, the bottom chime 14 and top chime 16 may be installed on and removed from the drum via conventional tools.

The above-described liquid storage tank 10 provides several advantages. For example, the alignment and anti-rotation geometry orients and retains the forklift openings 64A,B such that a forklift fork extending through the forklift openings 64A,B passes between the bung openings 40A,B without obscuring the bung openings 40A,B and without damaging the bung rims 32A,B or the top wall 20 of the drum 12 near the bung openings 40A,B. The alignment and anti-rotation is strong enough to prevent rotation of the top chime 16 relative to the drum 12 even when subjected to twisting forces associated with lifting the tank 10. The drainage channel 34 allows for water to drain off the top wall 20 of the drum 12 without needing to tip the tank 10 or removing the top chime 16 from the drum 12. The bottom engagement geometry and the top engagement geometry are strong enough to retain the chimes 14, 16 on the drum 12 when the liquid storage tank 10 is lifted with liquid in the interior chamber 24.

As mentioned above, the tank 10, bung openings 40A,B, and bung caps 42A,B may take several shapes and configurations. The following descriptions are merely examples of some of the combinations of tank sizes, bung openings, and bung caps that can be used.

Figure 5:
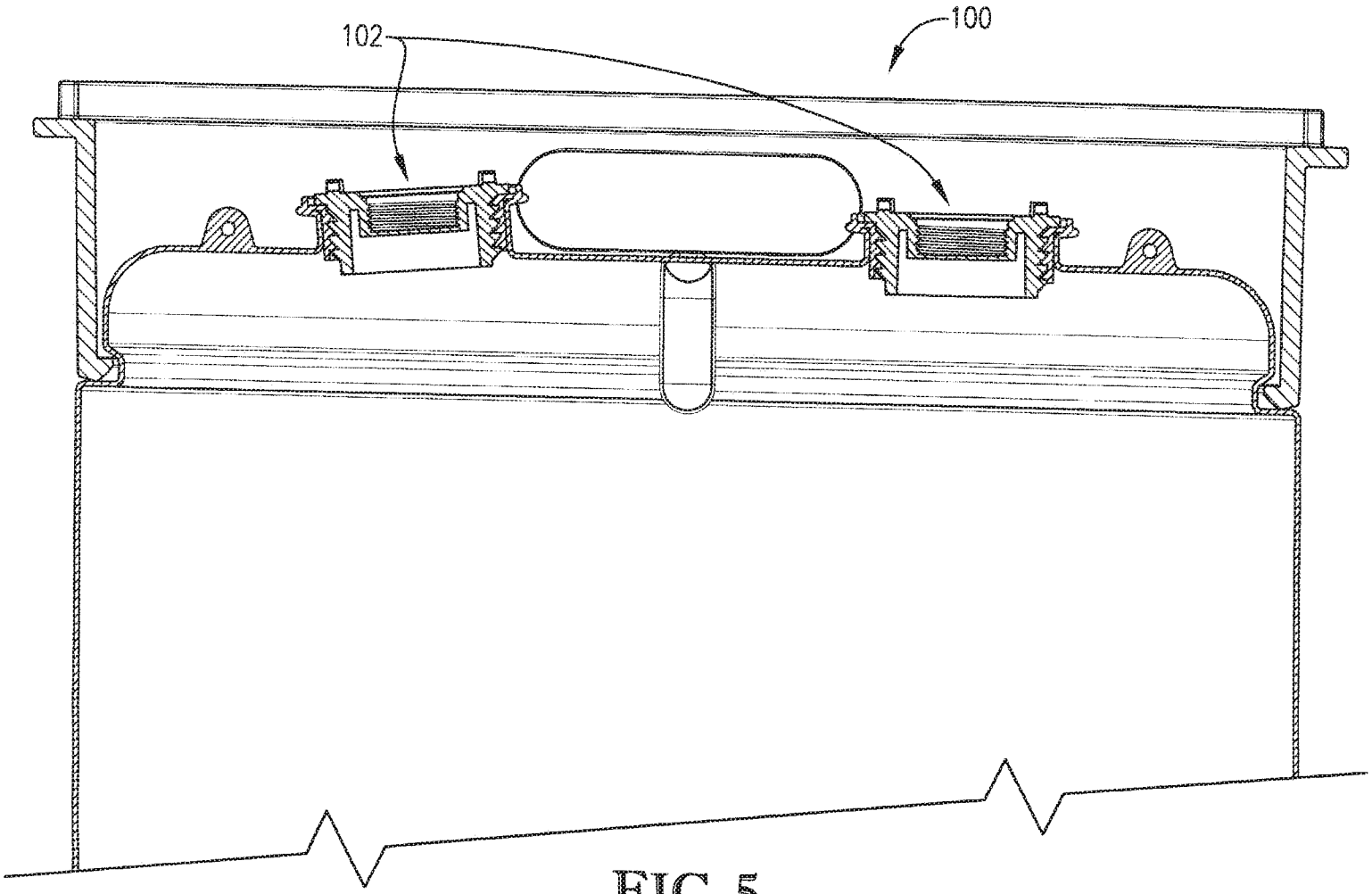
FIG. 5 is an enlarged partial cutaway view of a liquid storage tank constructed in accordance with another embodiment of the invention.

Turning to FIG. 5, a U.S. 15 gallon tank 100 is shown including bung openings 102 having a straight-angled configuration. That is, the right bung opening 102 is vertically oriented while the left bung opening 102 is angled away from the right bung angle slightly. The angled bung opening 102 may be angled any suitable amount such as 15 degrees from vertical.

Figure 6:
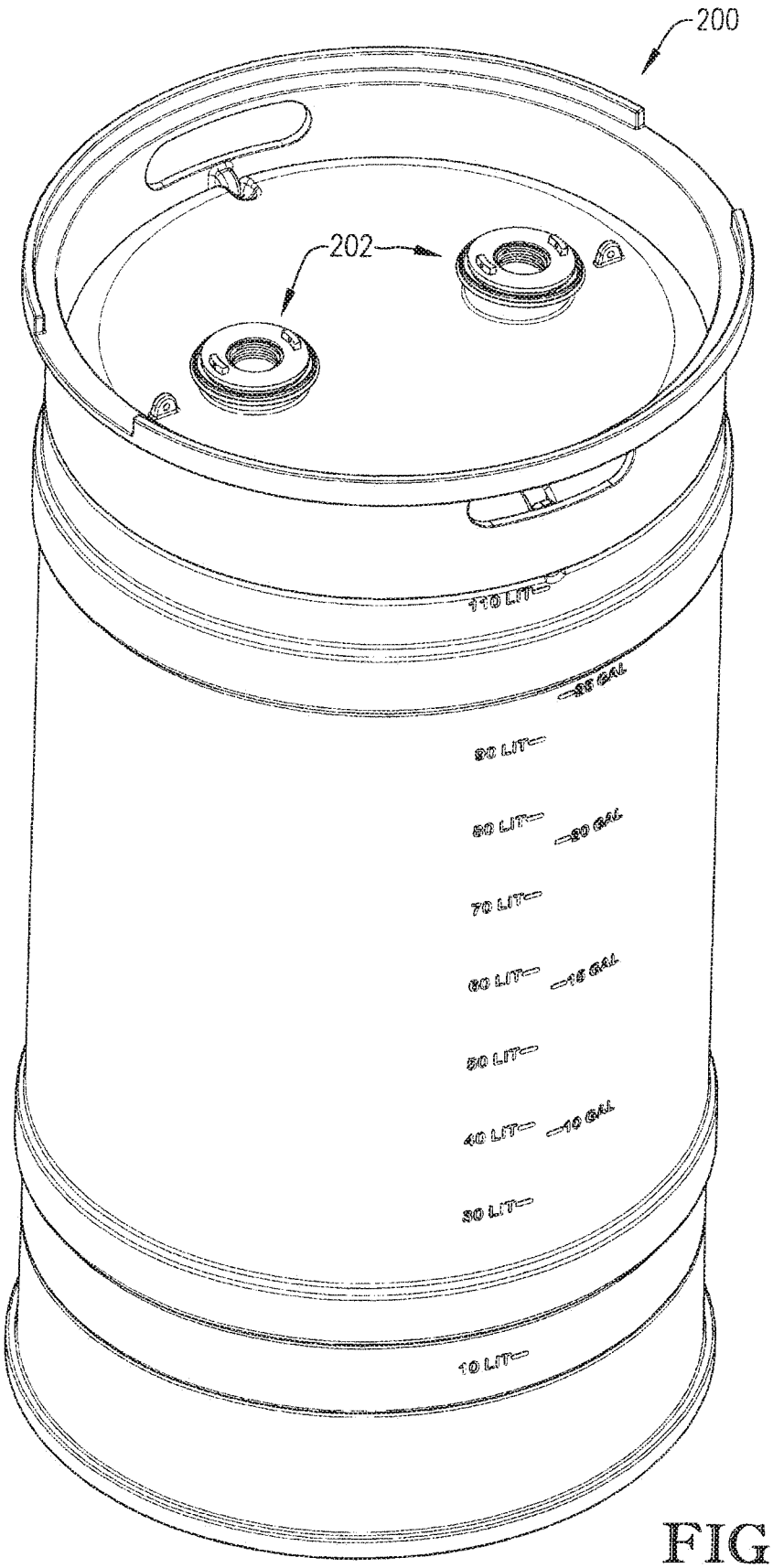
FIG. 6 is a perspective view of a liquid storage tank constructed in accordance with another embodiment of the invention.

Turning to FIG. 6, a U.S. 30 gallon tank 200 is shown including bung openings 202 having a straight-angled configuration similar to the straight-angled configuration of the bung openings 102 described above. The tank 200 may include incremental volume markings, such as gallons and liters, to indicate how much liquid is in the tank 200.

Figure 7:
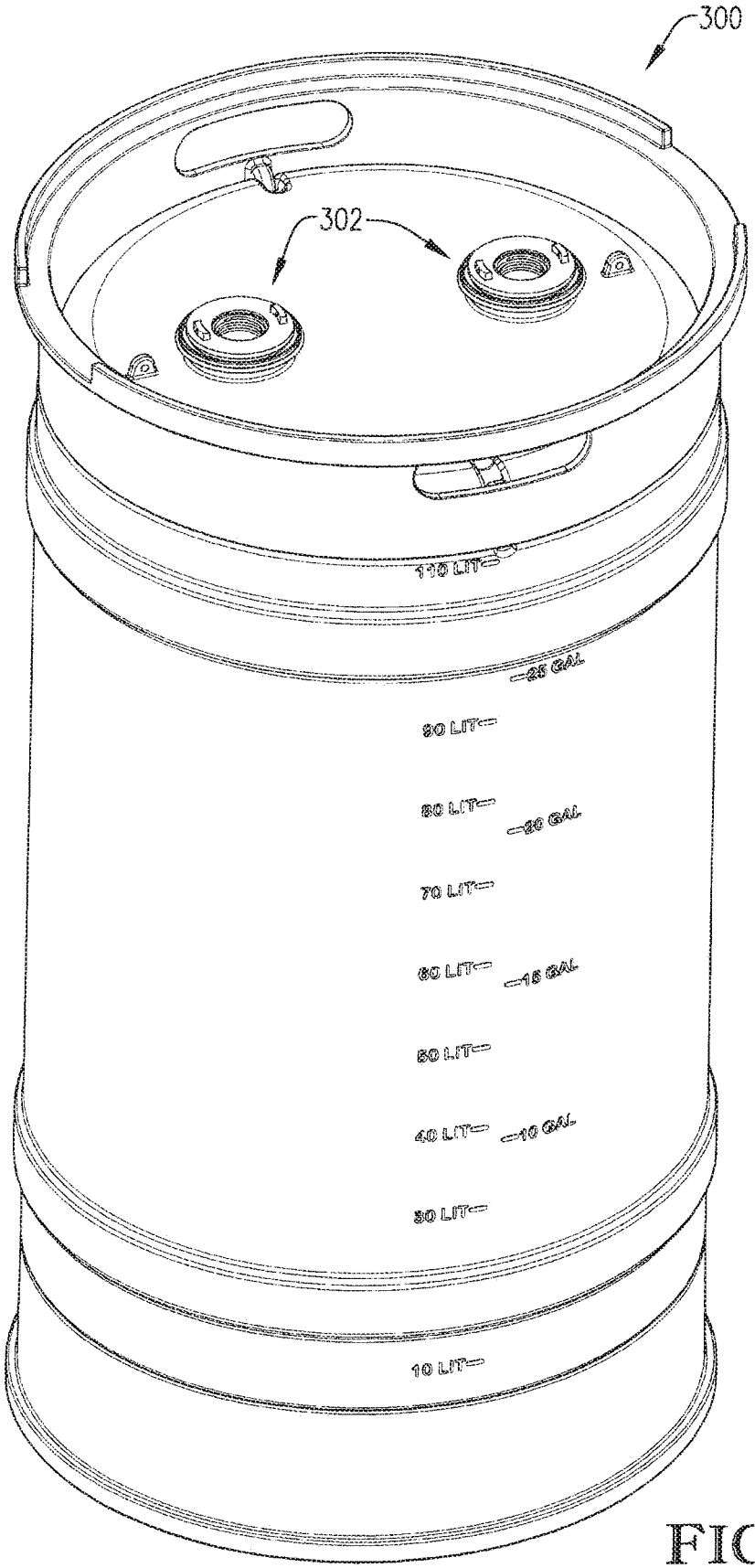
FIG. 7 is a perspective view of a liquid storage tank constructed in accordance with another embodiment of the invention.

Turning to FIG. 7, a U.S. 30 gallon tank 300 is shown including bung openings 302 having a straight-straight configuration similar to the bung openings 40A,B of tank 10 described above. That is, both bung openings 302 are vertically oriented.

Figure 9:
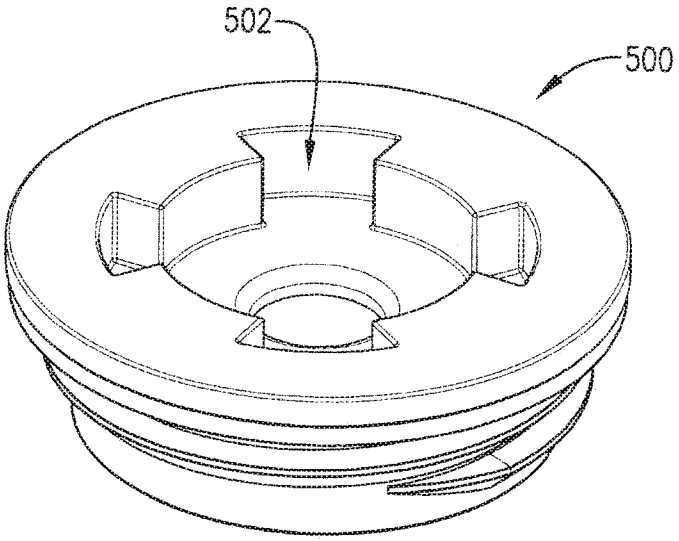
FIG. 9 is a perspective view of a bung cap constructed in accordance with another embodiment of the invention.
Figure 8:
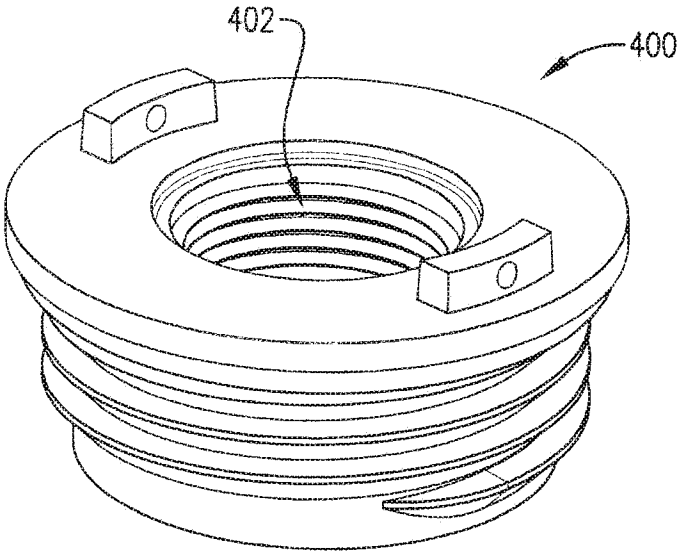
FIG. 8 is a perspective view of a bung cap constructed in accordance with another embodiment of the invention.
Figure 10:
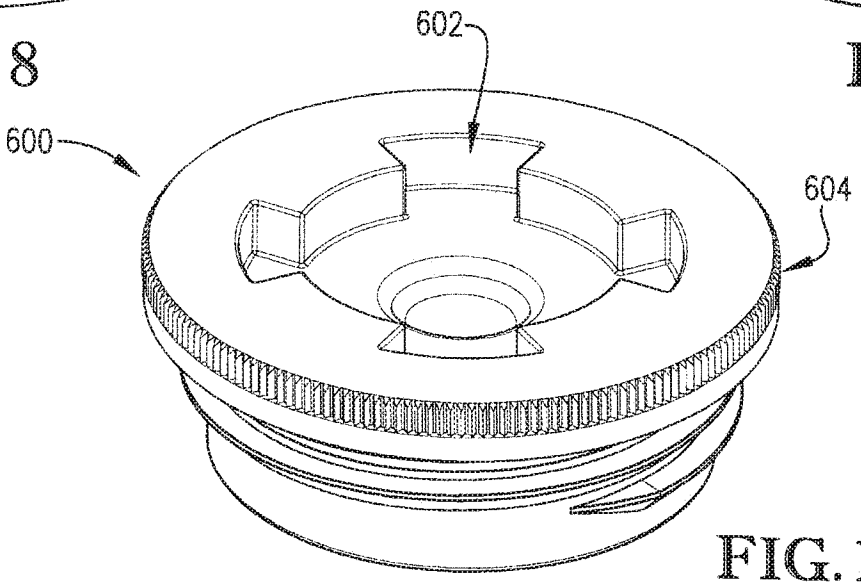
FIG. 10 is a perspective view of a bung cap constructed in accordance with another embodiment of the invention.

Turning to FIG. 8, a bung cap 400 is shown having helical geometry 402 for connecting a hose, pipe, spigot, or other conduit thereto. Turning to FIG. 9, a bung cap 500 is shown having a radial or star pattern 502 for turning the bung cap 500 via a driver tool or by hand. Turning to FIG. 10, a bung cap 600 is shown having a radial or star pattern 602 similar to the radial or star pattern 502 and annular gripping geometry 604 for turning the bung cap 600 via pliers or by hand.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A liquid storage tank comprising:

a cylindrical drum for holding liquids, the drum including:

a vertically extending sidewall having opposing top and bottom annular edges;

a top wall connected to the top edge of the sidewall;

a bottom wall connected to the bottom edge of the sidewall, wherein the sidewall, the top wall, and the bottom wall form an internal hollow chamber;

two bung openings formed in the top wall for filling the internal chamber with liquids and emptying the liquids from the internal chamber, the bung openings being spaced from each other, each bung opening being offset from a center of the top wall; and a complementary recess for alignment and anti-rotation;

a removable and replaceable bottom chime for elevating the drum above a ground surface, the bottom chime including:

a vertically extending chime sidewall having opposing inner and outer surfaces and opposing top and bottom edges; and drum engaging geometry near the top edge of the chime sidewall for positively connecting the bottom chime to the bottom wall of the cylindrical drum; and a removable and replaceable top chime for lifting the drum and protecting the top wall of the drum, the top chime including:

a vertically extending chime sidewall having opposing inner and outer surfaces and opposing top and bottom edges;

drum engaging geometry near the bottom edge of the chime sidewall of the top chime for positively connecting the top chime to the top wall of the drum;

alignment and anti-rotation geometry configured to engage the drum so as to prevent the top chime from rotating relative to the drum about a vertically extending axis, the alignment and anti-rotation geometry being a lug protrusion extending radially inwardly from the inner surface of the top chime, the lug protrusion being at least 0.5 inches long and having a thickness to width ratio of at least 0.5, the complementary recess of the drum being configured to receive the lug protrusion; and two forklift openings extending through the chime sidewall of the top chime for receiving a forklift fork therethrough such that the forklift fork extends from one of the forklift openings to the other forklift opening between the bung openings without obscuring the bung openings or damaging the top wall of the drum near the bung openings when the alignment and anti-rotation geometry is engaged with the drum, the top chime being configured to be retained on the drum via the drum engaging geometry of the top chime and rotationally locked with the drum via the alignment and anti-rotation geometry when the drum is holding liquid in the internal chamber and the drum is lifted via the forklift openings, each of the two forklift openings having a width of at least 4 inches.

2. The drum assembly of claim 1, wherein the drum and/or top chime further comprises a water drainage channel for allowing water to drain off the top wall of the drum when the top chime is connected to the drum.

3. The drum assembly of claim 2, wherein the drainage channel allows between 0.1 U.S. gallons per minute and 1 U.S. gallon per minute flow rate.

4. The drum assembly of claim 1, wherein the lug protrusion and complementary recess cooperatively form a water drainage channel for allowing water to drain off the top wall of the drum.

5. The drum assembly of claim 1, wherein the lug protrusion has a cross-sectional area of at least 0.75 square inches.

6. The drum assembly of claim 1, wherein the drum engaging geometry of the top chime is a flange protrusion extending radially inwardly from the inner surface of the top chime, the top wall of the drum further comprising a groove for receiving the inwardly extending flange protrusion.

7. The drum assembly of claim 6, wherein the flange protrusion extends annularly all the way around the inner surface of the top chime.

8. The drum assembly of claim 6, wherein the inwardly extending flange protrusion has at least 2.5 square inches of positive engagement area for ensuring that the top chime is retained on the drum when the drum is lifted.

9. The drum assembly of claim 1, wherein the top chime further comprises stacking geometry near the top edge of the top chime and the bottom chime further comprises complementary stacking geometry near the bottom edge of the bottom chime for stacking the drum assembly vertically between other drum assemblies.

10. The drum assembly of claim 1, wherein the top wall of the drum includes security seal bosses for connecting security seal wires between the bung caps and the top wall.

11. The drum assembly of claim 1, wherein the top chime and bottom chime are configured to only be removed from the drum via a single-purpose remove-and-replace tool.

12. The drum assembly of claim 1, wherein the top chime has an outer diameter equal to an outer diameter of the vertically extending sidewall of the drum.

13. The drum assembly of claim 1, wherein the bottom chime has an outer diameter equal to an outer diameter of the vertically extending sidewall of the drum.

14. The drum assembly of claim 1, wherein the top chime and bottom chime are formed of molded plastic.

15. A liquid storage tank comprising:

a cylindrical drum for holding liquids, the drum including:

a vertically extending sidewall having opposing top and bottom annular edges;

a top wall connected to the top edge of the sidewall;

a bottom wall connected to the bottom edge of the sidewall, wherein the sidewall, the top wall, and the bottom wall form an internal hollow chamber;

two bung openings formed in the top wall for filling the internal chamber with liquids and emptying the liquids from the internal chamber, the bung openings being spaced from each other, each bung opening being offset from a center of the top wall; and an alignment and anti-rotation lug protrusion recess;

a removable and replaceable bottom chime for elevating the drum above a ground surface, the bottom chime including:

a vertically extending chime sidewall having opposing inner and outer surfaces and opposing top and bottom edges; and drum engaging geometry near the top edge of the chime sidewall for positively connecting the bottom chime to the bottom wall of the cylindrical drum; and a removable and replaceable top chime for lifting the drum and protecting the top wall of the drum, the top chime including:

a vertically extending chime sidewall having opposing inner and outer surfaces and opposing top and bottom edges;

drum engaging geometry near the bottom edge of the chime sidewall of the top chime for positively connecting the top chime to the top wall of the drum;

an alignment and anti-rotation lug protrusion extending radially inwardly from the inner surface of the vertically extending chime sidewall of the top chime, the alignment and anti-rotation lug protrusion being configured to engage the drum via the alignment and anti-rotation lug protrusion recess of the drum so as to prevent the top chime from rotating relative to the drum about a vertically extending axis, the alignment and anti-rotation lug protrusion being at least 0.5 inches long and having a thickness to width ratio of at least 0.5; and two forklift openings extending through the chime sidewall of the top chime for receiving a forklift fork therethrough such that the forklift fork extends from one of the forklift openings to the other forklift opening between the bung openings without obscuring the bung openings or damaging the top wall of the drum near the bung openings when the alignment and anti-rotation geometry is engaged with the drum, the top chime being configured to be retained on the drum via the drum engaging geometry of the top chime and rotationally locked with the drum via the alignment and anti-rotation geometry when the drum is holding liquid in the internal chamber and the drum is lifted via the forklift openings.

16. The drum assembly of claim 15, wherein the alignment and anti-rotation lug protrusion has a cross-sectional area of at least 0.75 square inches.

17. The drum assembly of claim 15, wherein the alignment and anti-rotation lug protrusion and alignment and anti-rotation lug protrusion recess cooperatively form a water drainage channel for allowing water to drain off the top wall of the drum.

18. A liquid storage tank comprising:

a cylindrical drum for holding liquids, the drum including:

a vertically extending sidewall having opposing top and bottom annular edges;

a top wall connected to the top edge of the sidewall, the top wall including a flange protrusion receiving groove;

a bottom wall connected to the bottom edge of the sidewall, wherein the sidewall, the top wall, and the bottom wall form an internal hollow chamber; and two bung openings formed in the top wall for filling the internal chamber with liquids and emptying the liquids from the internal chamber, the bung openings being spaced from each other, each bung opening being offset from a center of the top wall;

a removable and replaceable bottom chime for elevating the drum above a ground surface, the bottom chime including:

a vertically extending chime sidewall having opposing inner and outer surfaces and opposing top and bottom edges; and drum engaging geometry near the top edge of the chime sidewall for positively connecting the bottom chime to the bottom wall of the cylindrical drum; and a removable and replaceable top chime for lifting the drum and protecting the top wall of the drum, the top chime including:

a vertically extending chime sidewall having opposing inner and outer surfaces and opposing top and bottom edges;

a drum engaging flange protrusion extending radially inwardly from the inner surface of the top chime near the bottom edge of the chime sidewall of the top chime for positively connecting the top chime to the top wall of the drum via the flange protrusion receiving groove of the top wall of the drum, the drum engaging flange protrusion having at least 2.5 square inches of positive engagement area for ensuring the top chime is retained on the drum when the drum is lifted;

alignment and anti-rotation geometry configured to engage the drum so as to prevent the top chime from rotating relative to the drum about a vertically extending axis; and two forklift openings extending through the chime sidewall of the top chime for receiving a forklift fork therethrough such that the forklift fork extends from one of the forklift openings to the other forklift opening between the bung openings without obscuring the bung openings or damaging the top wall of the drum near the bung openings when the alignment and anti-rotation geometry is engaged with the drum, the top chime being configured to be retained on the drum via the drum engaging geometry of the top chime and rotationally locked with the drum via the alignment and anti-rotation geometry when the drum is holding liquid in the internal chamber and the drum is lifted via the forklift openings.

* * * * *